US006087990A

United States Patent [19]

Thill et al.

[11] Patent Number: 6,087,990

[45] Date of Patent: Jul. 11, 2000

[54] DUAL FUNCTION COMMUNICATION ANTENNA

[75] Inventors: Kevin M. Thill, Scottsdale, Ariz.; William J. Liimatainen, Monroe, Wis.

[73] Assignee: Antenna Plus, LLC, Scottsdale, Ariz.

[21] Appl. No.: 09/241,719

[22] Filed: Feb. 2, 1999

[51] Int. Cl.[7] ..... H01Q 1/38

[52] U.S. Cl. ..... 343/700 MS; 343/830; 343/853

[58] Field of Search ..... 343/700 MS, 702, 343/829, 830, 849, 846, 713, 826, 827, 853

[56] References Cited

U.S. PATENT DOCUMENTS

| | | | |
|---|---|---|---|
| 4,089,003 | 5/1978 | Conroy | 343/700 MS |
| 4,218,682 | 8/1980 | Yu | 343/700 MS |
| 5,041,838 | 8/1991 | Liimatainen et al. | 343/700 |
| 5,121,127 | 6/1992 | Toriyama | 343/700 MS |
| 5,323,168 | 6/1994 | Itoh et al. | 343/700 MS |
| 5,438,338 | 8/1995 | Thill | 343/700 |
| 5,568,155 | 10/1996 | Tsunekawa et al. | 343/700 MS |
| 5,625,365 | 4/1997 | Tom et al. | 343/700 MS |

*Primary Examiner*—Don Wong
*Assistant Examiner*—Tho Phan
*Attorney, Agent, or Firm*—Quarles & Brady LLP; George E. Haas

[57] ABSTRACT

An antenna assembly has a first antenna with a planar dielectric first substrate and electrically conductive layers on opposing major surfaces of the first substrate. One or more hollow electrical shunts extend between the conductive layers and separate conductors are connected to the geometric centers of each conductive layer to carry communication signals to and from the first antenna. A second antenna abuts the first antenna and has a second planar substrate of dielectric material with a conductive radiating pattern on one surface. In an active version of the second antenna, a low noise amplifier is mounted on the second substrate. Another conductor extends through the hollow electrical shunt and is connected to the conductive pattern.

16 Claims, 1 Drawing Sheet

DUAL FUNCTION COMMUNICATION ANTENNA

BACKGROUND OF THE INVENTION

The present invention relates to antennae for two-way communication and global positioning satellite systems, and more particularly to planar antennae for such applications.

Cellular telephones commonly are used for mobile communication with passengers in vehicles. Such telephones usually have a hand-held unit which includes a microphone, a small speaker and a keypad for placing calls and controlling the operation of the telephone. The hand-held unit is coupled by a cable to an electronics module that contains a radio frequency transceiver. The transceiver in turn is coupled to an antenna on the exterior of the vehicle to send and receive the radio frequency signals. Cellular telephones transmit in the 824 to 845 MHz frequency band and receive signals in the 870 to 896 MHz frequency band.

A typical cellular telephone antenna for a motor vehicle is attached to the exterior surface of a window and comprises a short section of rigid wire extending vertically from the vehicle body. A coupling box is mounted on the interior surface of the window opposite to the antenna and is connected by a coaxial cable to the transceiver. The coupling box and the antenna are electrically coupled so that signals from the transmitter section of the transceiver are applied to the exterior wire from which the signals radiate. The coupling also allows radio frequency signals to be received by the exterior element and applied to the receiver section of the transceiver.

Even though such cellular telephone antennae are relatively short, protruding approximately one foot from the surface of the vehicle, they are subject to accidental breakage and acts of vandalism. Although cellular telephone antennae are considered by some people to be a status symbol, others may consider them to be unsightly and a detraction from the aesthetic appearance of the vehicle.

U.S. Pat. No. 5,041,838 discloses a low profile, flat disk-shaped antenna for bidirectional communication, such as cellular telephones. This antenna is attached to a horizontal exterior surface of the motor vehicle, such as the roof. A coaxial cable extends through a hole in that surface, coupling the external antenna to the transceiver inside the motor vehicle.

Motor vehicles are now available with receivers for the Global Positioning System (GPS) to provide location determination and navigation. The GPS consists of twenty-four artificial earth satellites positioned in a constellation so that typically seven, but a minimum of four, satellites will be observable by a receiver anywhere on or near the earth's surface. Each GPS satellite transmits data via L-band frequency signals that allow receivers on the earth to precisely measure the distance to that satellite and thereafter to compute the user's position (longitude and latitude) and velocity to a high degree of accuracy using conventional triangulation techniques.

Heretofore separate antennae were required to be mounted on a motor vehicle for GPS, a cellular telephone or other bidirectional radio equipment. This multiple antennae arrangement often detracted from the aesthetic appearance of the motor vehicle.

SUMMARY OF THE INVENTION

A general object of the present invention is to provide an antenna assembly for simultaneous use by bidirectional communication equipment and a global positioning satellite receiver.

Another object is to provide such an antenna assembly which has low-profile for aesthetic and aerodynamic reasons.

These and other objectives are satisfied by an antenna assembly which includes a first antenna for connection to a communication transceiver and a second antenna for use by a global positioning satellite receiver.

The first antenna has a first planar substrate of dielectric material with two major surfaces and electrically conductive layers on the two major surfaces. At least one electrical shunt extends through the first planar substrate and is connected to the electrically conductive layers. A transmission line or medium, such as a coaxial cable, is connected to the electrically conductive layers to carry communication signals to and from the first antenna.

The second antenna abuts the first antenna and includes a second planar substrate of dielectric material. A conductive pattern is applied to a surface of the second planar substrate and a conductor is connected to the conductive pattern. The conductive pattern preferably has a rectangular patch shape with the conductor being connected offset from a corner of the conductive pattern.

In an alternative embodiment of the antenna assembly, the second antenna is active, having a low noise amplifier mounted to the second planar substrate and connected to the conductive pattern.

DETAILED DESCRIPTION OF THE INVENTION

Figure 1:
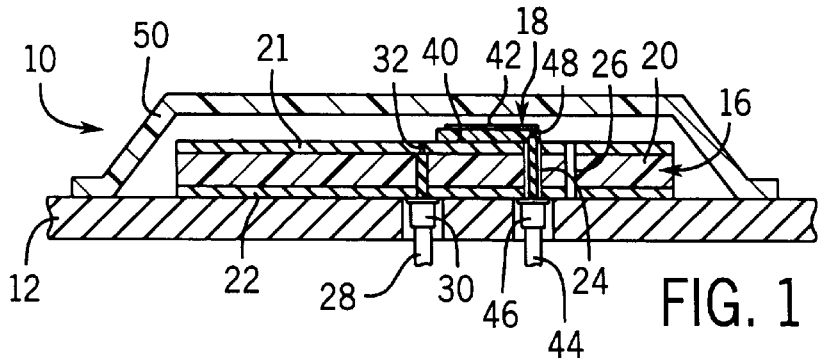
FIG. 1 is a cross sectional view of a low-profile antenna assembly according to the present invention.

With initial reference to FIG. 1, a dual function antenna assembly 10 according to the present invention is mounted on a flat surface, such as the roof 12 of a motor vehicle. The antenna assembly 10 comprises a first antenna 16 for bidirectional communication and a second antenna 18 for receiving signals for determining the location of the motor vehicle, such as signals from the global positioning satellite system.

The first antenna 16 is formed by a disk-shaped substrate 20 of a dielectric material, such as PMI foam or a PTFE composite. The diameter of the substrate 20 is less than one-half the wavelength of the radio signals which the antenna is to transmit and receive. Limiting the diameter in this matter prevents high order modes from being excited. For example, for frequencies commonly used for cellular telephone transmission, the substrate 20 is three inches in diameter and 0.5 inches thick.

The top and bottom flat major surfaces on opposite sides of the substrate 20 have respective conductive layers 21 and 22, of copper or brass, laminated thereon and covering the entirety of the respective major surface. Two conductive tuning posts 24 and 26 extend through first substrate 20 electrically connecting the first and second conductive layers 21 an 22. Each tuning post 24 and 26 can be a hollow rivet with heads at both ends that are soldered to the respective conductive layer. Alternatively, the tuning post may be inserted through the substrate 20 and then the first and second conductive layers 21 and 22 are deposited on the major surfaces of the substrate in electrical contact with the tuning posts. In the exemplary first antenna 16, the tuning posts 24 an 26 are aligned axially on the same side of the center of the substrate 20. The precise number and locations of the tuning posts are a function of the radio frequencies to be received and/or transmitted by the antenna. An antenna of this general type is described in our prior U.S. Pat. No. 5,041,838 entitled "Cellular Telephone Antenna" which description is expressly incorporated by reference herein.

A conventional first coaxial cable 28 extends through a hole in the motor vehicle roof 12 and is attached to substantially the geometric center of the first antenna The shield conductor of the first coaxial cable 28 is electrically connected by a coupling 30 to the second, or bottom, conductive layer 22 of the first antenna and the cable's central conductor 32 is connected to the first, or top, conductive layer 21. First coaxial cable 28 connects the first antenna to a radio frequency transceiver, such as for a cellular telephone for example, within the motor vehicle.

Figure 2:
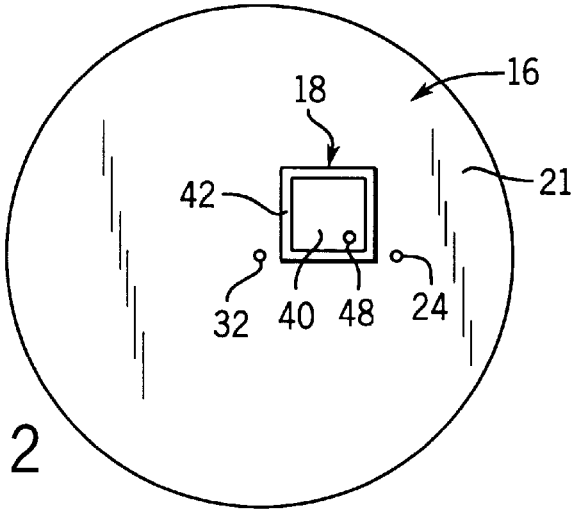
FIG. 2 is a plane view of the top of an internal combination of antennae in the antenna assembly.

Referring to FIGS. 1 and 2, the second antenna 18 is mounted to the first conductive layer 21 on top of the first antenna 16. The second antenna 18 has a rectangular, preferably square, substrate 42 of dielectric material similar to the substrate 20 of the first antenna 16. A major surface of the substrate 42 abuts the first antenna 16 and the opposite major surface has a conductive rectangular area 40, as seen in FIG. 2.

A second coaxial cable 44 extends through another hole in the motor vehicle roof 12. The shield conductor of the second coaxial cable 44 is electrically connected by a coupling 46 to the second, or bottom, conductive layer 22 of the first antenna 16 which also serves as a ground plane of the second antenna 18. The central conductor 48 of the second coaxial cable 44 extends through, but is insulated from, one of the hollow conductive tuning posts 24 and is connected to one corner of the conductive pattern 40 of the second antenna 18. This forms a conventional corner fed antenna element. The second coaxial cable 44 connects the second antenna to a global positioning system receiver within the motor vehicle. Alternatively a single twinaxial cable with two inner conductors within a conductive shield could be used in place of the separate coaxial cables 28 and 44.

A decorative and protective plastic cover 50 extends over the combination of the first and second antennae 16 and 18 and may be colored to match or complement the color of the body of the motor vehicle. The sides of the cover 26 are angled for aerodynamic and aesthetic purposes.

Figure 3:
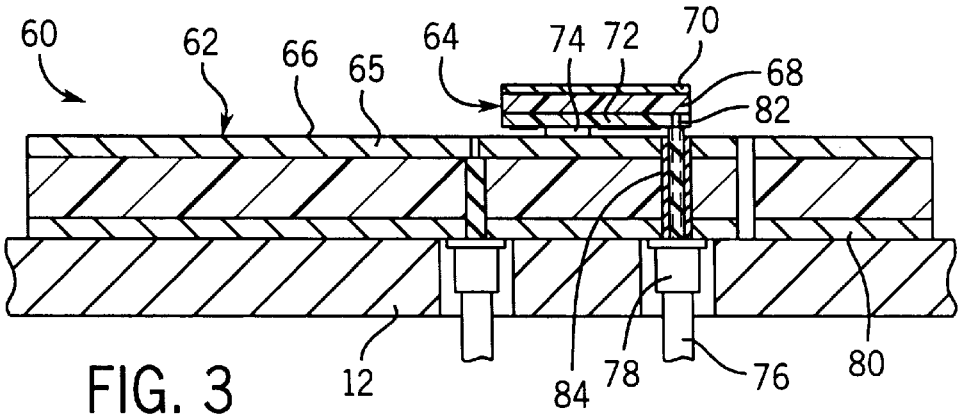
FIG. 3 is a cross sectional view of an alternative embodiment of the low-profile antenna assembly.

The embodiment of the antenna assembly illustrated in FIG. 1 employs a passive second antenna 18 for the global positioning system. Alternatively an active GPS antenna may be incorporated as shown in FIG. 3. In this second antenna assembly 60, the first antenna 62 has the same structure as the first antenna in FIG. 1 and has the second antenna 64 mounted to its upper surface 66. The active second antenna 64 has a rectangular, preferably square, substrate 68 of dielectric material with top and bottom surfaces. The conductive pattern 70, such as a rectangular patch 40 shown in FIG. 2, is applied to the upper surface of substrate 68. A printed circuit board 72 having a low noise amplifier (LNA) 74 is attached to the bottom surface of substrate 68 and electrically connected to the conductive pattern 70. Although not illustrated, the second antenna assembly 60 is within a protective cover similar to cover 50 in FIG. 1.

The coaxial cable 76 for the GPS receiver extends through the motor vehicle roof 12 and has a shield conductor electrically connected by a connector 78 to the second, or bottom, conductive layer 80 of the first antenna 16. Note that the shield of coaxial cable 76 is coupled through connector 78, tuning post 84 and the upper conductive layer 65 of the first antenna, which also serves as a ground plane of the second antenna 18. The upper conductive layer 65 is connected to the printed circuit board 72. The central conductor 82 of the GPS coaxial cable 76 extends through a hollow conductive tuning post 84 and is connected to the printed circuit board 72 of the second antenna 64. The coaxial cable 76 also carries a direct current which powers the low noise amplifier 74 and any other active devices on the printed circuit board 72.

To enhance the aesthetics of the motor vehicle, the present dual function antenna assembly can be combined into the conventional third brake light. This combination conceals the multiple antennae. Alternatively the dual function antenna assembly can be located in a depression or recess in the roof, trunk or body panel of the motor vehicle. The recess then is covered with a composite skin which is painted to match the body color of the vehicle.

What is claimed is:

1. An antenna assembly comprising:

a first antenna having a first planar substrate of dielectric material with two major surfaces, a first electrically conductive layer on one of the two major surfaces and having a geometric center, a second electrically conductive layer on another one of the two major surfaces and having another geometric center, and at least one electrical shunt connected off center to the first electrically conductive layer and connected off center to the second electrically conductive layer;

a transmission medium connected to substantially the geometric center of the first electrically conductive layer and connected to substantially the geometric center of the second electrically conductive layer to carry communication signals to and from the first antenna;

a second antenna having a second planar substrate of dielectric material with first and second major surfaces, the first major surface facing the first electrically conductive layer of the first antenna, and having a conductive pattern on the second major surface; and a secondary conductor extending through one of the at least one electrical shunt and connected to the conductive pattern.

2. The antenna assembly as recited in claim 1 wherein the first antenna is disk-shaped.

3. The antenna assembly as recited in claim 1 wherein the first and second major surfaces of the second antenna are rectangular, and the conductive pattern has a rectangular shape.

4. The antenna assembly as recited in claim 1 wherein the conductive pattern has a rectangular shape.

5. The antenna assembly as recited in claim 4 wherein the secondary conductor is connected adjacent to a corner of the conductive pattern.

6. The antenna assembly as recited in claim 1 wherein the second antenna further includes an amplifier coupling the conductive pattern to the secondary conductor.

7. An antenna assembly comprising:

a first antenna having a first planar substrate of dielectric material with first and second major surfaces, a first electrically conductive layer on the first major surface and having a geometric center, and a second electrically conductive layer on the second major surface and having another geometric center, the first antenna having a hollow electrical shunt extending through the first planar substrate and connected off center to the first and second electrically conductive layers;

a pair of electrical conductors each being connected to substantially the geometric center of a different one of the first and second electrically conductive layers to carry communication signals to and from the first antenna;

a second antenna having a second planar substrate of dielectric material with third and fourth major surfaces, with the third major surface abutting the second conductive layer of the first antenna, the second antenna having a conductive pattern on the fourth major surface; and a secondary conductor extending through the hollow electrical shunt of the first antenna and connected to the conductive pattern.

8. The antenna assembly as recited in claim 7 wherein the first antenna is disk-shaped.

9. The antenna assembly as recited in claim 7 wherein the conductive pattern has a rectangular shape.

10. The antenna assembly as recited in claim 9 wherein the secondary conductor is connected offset from a corner of the conductive pattern.

11. An antenna assembly comprising:

a first antenna having a first planar substrate of dielectric material with first and second major surfaces, a first electrically conductive layer on the first major surface and having a geometric center, and a second electrically conductive layer on the second major surface and having another geometric center, the first antenna having an electrical shunt extending between and connected off center to the first and second electrically conductive layers;

a pair of electrical conductors each being connected to substantially the geometric center of a different one of the first and second electrically conductive layers to carry communication signals to and from the first antenna;

a second antenna abutting the first antenna and having a second planar substrate of dielectric material with third and fourth major surfaces, the second antenna having a low noise amplifier attached to the third major surface and having a conductive pattern on the fourth major surface; and a secondary conductor connected to the conductive pattern.

12. The antenna assembly as recited in claim 11 wherein the first antenna is disk-shaped.

13. The antenna assembly as recited in claim 11 wherein the third and fourth major surfaces of the second antenna are rectangular and the conductive pattern is rectangular.

14. The antenna assembly as recited in claim 11 wherein the conductive pattern has a rectangular shape.

15. The antenna assembly as recited in claim 14 wherein the secondary conductor is connected offset from a corner of the conductive pattern.

16. The antenna assembly as recited in claim 14 wherein the secondary conductor is connected closer to one corner of the rectangular shape than to any other corner.

* * * * *